United States Patent [19]

Fischer et al.

[11] 4,023,495

[45] May 17, 1977

[54] TWIST BRAKES FOR PROJECTILES

[75] Inventors: Siegmar Fischer; Karl-Heinz Silligmann; Jüergen Prochnow, all of Duesseldorf, Germany

[73] Assignee: Rheinmetall G.m.b.H, Duesseldorf, Germany

[22] Filed: Apr. 12, 1976

[21] Appl. No.: 675,826

[30] Foreign Application Priority Data

Apr. 26, 1975 Germany ..... 2518645

[52] U.S. Cl. ..... 102/35.6; 244/3.29

[51] Int. Cl.[2] ..... F42B 13/38

[58] Field of Search ..... 102/35.6; 244/3.27, 244/3.29

[56] References Cited

UNITED STATES PATENTS

| | | | |
|---|---|---|---|
| 3,695,556 | 10/1972 | Gauzza | 244/3.29 |
| 3,702,588 | 11/1972 | Simmons | 244/3.29 |
| 3,719,339 | 3/1973 | Simmons et al. | 244/3.27 |
| 3,768,755 | 10/1973 | Prochnow et al. | 102/35.6 |

FOREIGN PATENTS OR APPLICATIONS

| | | | |
|---|---|---|---|
| 2,260,772 | 10/1975 | France | 102/35.6 |
| 2,429,912 | 1/1975 | Germany | 102/35.6 |

*Primary Examiner*—Verlin R. Pendegrass

[57] ABSTRACT

An improved twist brake for the separable payload of a twist or spin-stabilized flare or smoke projectile is described. A pair of pivotable wings, secured at one end to a portion of a central shaft of the payload, is normally engaged by the inner surface of a guide shoe which prevents contact of the wing with the separable housing of the payload. Cooperable projections and slots on the guide shoe and the central support shaft prevent substantial axial and circumferential movement of the shoe, while permitting outward movement of the wings and the guide shoes when the payload separates from the housing. During such separation, the guide shoe is also separated from the wings so that the latter can pivot to their maximum extent to provide an optimum rotational braking action on the payload.

4 Claims, 4 Drawing Figures

TWIST BRAKES FOR PROJECTILES

BACKGROUND OF THE INVENTION

The invention relates to twist brakes associated with a separable payload portion of a twist-stabilized flare or smoke projectile.

The ejectable payloads in twist projectiles of this type are provided with a twist brake that includes a central support shaft and a plurality of arcuate wings which are pivoted at one end to the support shaft. The wings are normally confined within the separable housing of the payload, with the free ends of the wings bearing against the inner wall of the separable payload housng. Upon separation of the payload from the housing, the wings are permitted to pivot to their full outward position in order to effect a braking action on the rotational speed of the ejected payload.

A disadvantage of existing wing-type twist brakes of this type is that the forces generated during separation of the payload from the housing cause a rapid rotation of the relatively thin outer surfaces of the wings against the inner wall of the housing. Such movement frequently causes damage to the wings and prevents them from exhibiting an optimum braking effect when fully expanded.

SUMMARY OF THE INVENTION

Such disadvantage is overcome by the improved twist-brake construction in accordance with the invention. In an illustrative embodiment, a plurality of guide shoes are interposed between the respective wings and the wall of the separable housing to isolate the relatively thin outer surface of the wings from contact with the housing. During the generation of high acceleration forces, as in firing of the projectile and ejection of the payload, the outward thrust of the payload components will cause the outer surface of the guide shoe, rather than the wings, to contact the housing wall.

Preferably, the guide shoe and the central support shaft to which the wings are pivoted are provided with cooperating projections and slots to inhibit axial and circumferential movements of the guide shoe prior to ejection. Such inhibiting arrangement, on the other hand, permits radially outward movements of the wings and the guide shoe after ejection, and permits the guide shoe to separate from the wings so that the latter can pivot outwardly to their maximum extent for optimum braking purposes.

BREIF DESCRIPTION OF THE DRAWING

The invention is further set forth in the following detailed description taken in conjunction with the appended drawing, in which.

DETAILED DESCRIPTION

Figure 1:
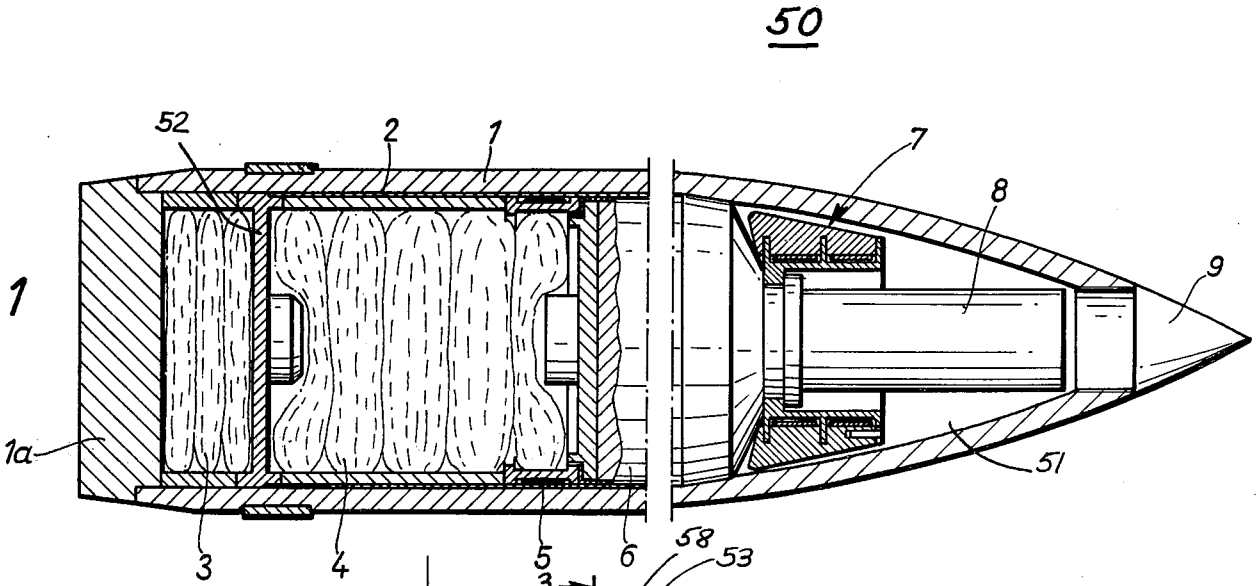
FIG. 1 is a longitudinal view in section of a twist projectile having an improved payload twist-brake in accordance with the invention.

Referring now to the drawing, the numeral 50 depict a twist-stabilized flare projectile having a base portion 1*a* which carries a separable elongated housing 1 of a payload portion 51. The rear portion of the housing 1 surrounds a first parachute 3. Forwardly of the parachute 3 and separated therefrom by means of a partition wall 52 is a main parachute 4, a forward portion of which is surrounded by a first twist-brake 5 of conventional construction. A flare section 6 containing the operational flare compound (not shown) is disposed forwardly of the parachute 4. A compartment wall 2 substantially surrounds the parachutes 3, 4, the twist-brake 5 and the flare section 6.

Forwardly of the compartment 2, the projectile includes a central detonating charge section 8 which terminates adjacent a nose detonator section 9, the detonation of the charge in the section 8 effecting the separation of the payload 51 from the housing 1 surrounding it in a conventional manner.

A second twist-brake 7, constructed in accordance with the invention, surrounds the rear surface of the charge section 8. As shown best in FIGS. 2–3, the brake 7 includes a central, elongated cylindrical support cage 12 having three radial projections 12*a*, 12*a* extending from an outer surface 53 thereof, i.e., at positions disposed at the respective ends and at a central portion of such outer surface.

Figure 2:
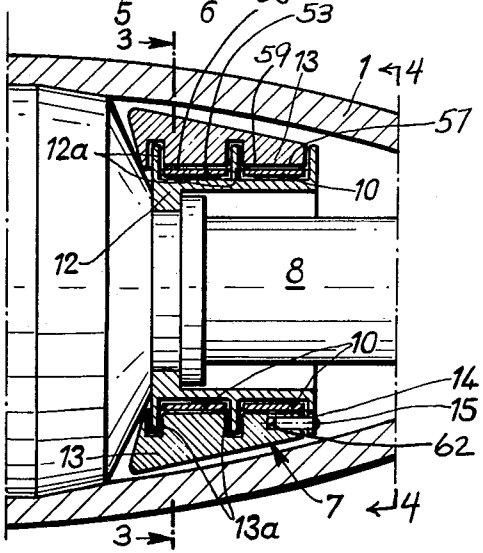
FIG. 2 is an enlarged fragmentary view, in section, of the payload portion of the projectile of FIG. 1, illustrating additional details of the twist-brake.
Figure 3:
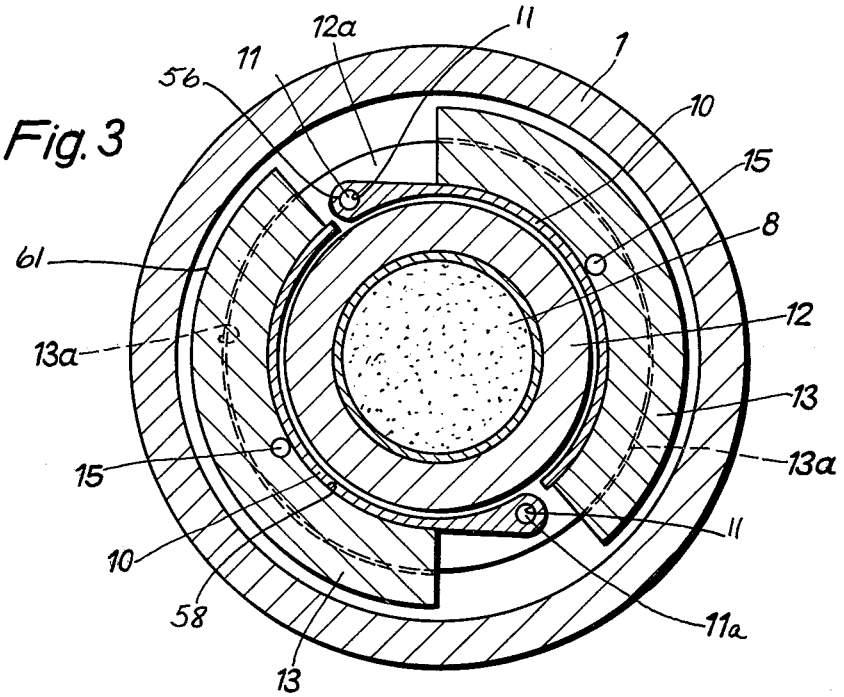
FIG. 3 is a sectional view taken along line 3—3 of FIG. 2.

As shown best in FIG. 3, a pair of diametrically opposed bores 11, 11 extend axially through the projections 12*a* for receiving a pair of pivot pins 11*a*, 11*a*. The pins 11*a* individually mount respective first enlarged ends 56, 56 of a pair of arcuate braking wings 10, 10 for pivotal movement in an essentially radially outward direction from a nominally confined position in surrounding relation to the conforming outer surface 53 of the cage 12. The wings 10 shown in FIG. 3 are disposed in circumferential succession around a portion of the outer surface of the cage 12 between the rear and the central radial projections 12*a*. As indicated in FIG. 2, however, an additional set of the wings 10 may be likewise distributed on an axially spaced portion of the outer surface 53, i.e., on the portion thereof between the central and front projections 12*a*.

Ordinarily, the generation of severe acceleration forces within the projectile are effective to urge the pivoted wings 10 radially outward toward their open position, i.e., to a position in engagement with the inner wall of the separable housing 1. In the past, the rapid rotation of such contacting wings on such inner surface has led to damage of the wings, thereby precluding optimum braking performance of the wings when such wings are permitted to open to their fully extended position after separation of the payload from the housing. In accordance with the invention, the wings 10 are insulated from such deleterious contact with the housing 1 by the interposition of a pair of guide shoes 13, 13 in the form of arcuate segments which extend along the axis of the projectile 1 and which are radially interposed between the outer surface of the associated wing 10 and the inner wall of the housing 1. An inner surface 57 of each of the guide shoes 13 exhibits a pair of axially spaced portions 58 and 59 for overlying the wings 10 that are individually disposed on axially opposite sides of the central projection 12*a* of the cage 12. In FIG. 3, for example, the inner surface portions 58 of each of the two guide shoes illustrated conform to and overlie a major portion of the outer surface of the associated wings 10 in regions circumferentially spaced from the enlarged pivoted end 11. An outer surface 61 of each of the guide shoes 13 normally terminates adjacent the inner surface of the separable housing 1, so that in the presence of acceleration forces the outward movement of the wings 10 will normally force the outer edges 61 of the shoes 13 against the inner wall of the housing 1. The inner surface portions 58, 59 of the shoes 13 will remain in engagement with the outer surface of the associated wings 10 at all times prior to the separation of the payload from the housing 1.

Figure 4:
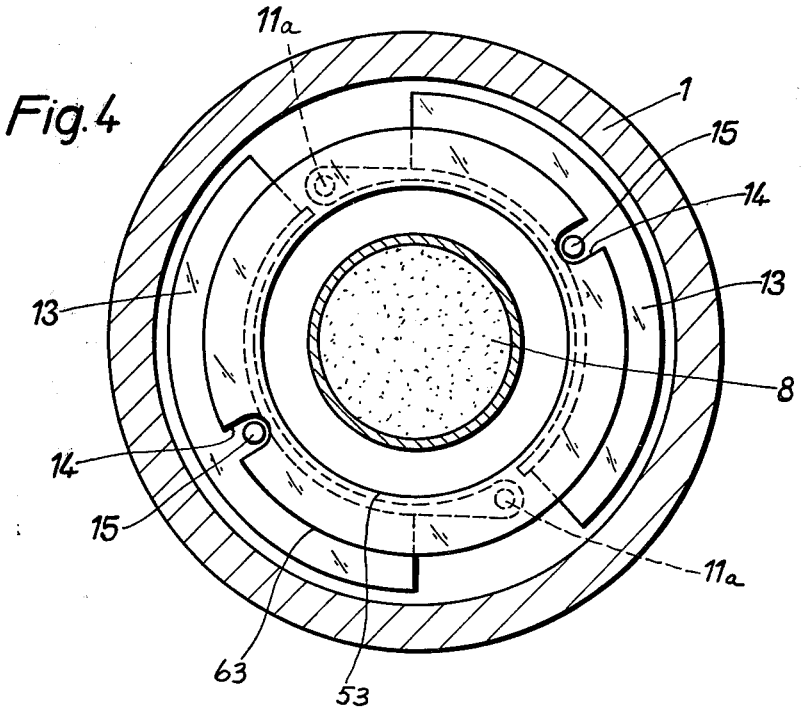
FIG. 4 is a sectional view taken along line 4—4 of FIG. 2.

In order to substantially immobilize the shoes 13 from circumferential and axial movement with respect to the cage 12 while at the same time permitting free, radially outward movement of the guide shoes and the wings after payload ejection, each shoe 13 is provided with (a) a pair of slots 13*a*, 13*a* in radial alignment with and received within the rear and central projections 12*a* on the cage 12, and (b) an axial slot 62 extending inwardly from the front end thereof for receiving a pin 15 which is cooperable with a recess 14 in an outer surface 62 of the front projection 12*a* on the cage 12. In particular, the cooperation of the projections 12*a* and the slots 13 *a* prevent substantial axial movements of the guide shoes 13 with respect to the cage 12, while the extension of the axial pin 15 through the slot 14 (FIG. 4) prevents substantial circumferential movement of the shoes 13 relative to the cage 12.

In the operation of the arrangement shown in FIGS. 1–4, in the period prior to ejection of the payload the wings 10 and the adjacent guide shoes 13 are disposed in the position shown in FIG. 3 in the absence of acceleration forces, and in a position slightly radially outward thereof in the presence of acceleration forces; in the latter case, the outer surface 61 is in contact with the inner wall of the housing 1. Upon separation of the payload from the housing, the wings 10 are free to rotate outwardly about their pivot pins 11*a*, thereby simultaneously propelling the adjacent guide shoes 13 out of the restraining slots 12*a* and 14, whereupon the shoes 13 are free to separate from the wings. When this happens, the wings are free to assume their extreme outward positions to provide an optimum braking action on the rotation of the now-free payload.

In the foregoing, an illustrative arrangement of the invention has been described. Many variations and modifications will now occur to those skilled in the art. It is accordingly desired that the scope of the appended claims not be limited to the specific disclosure herein contained.

What is claimed is:

1. In a twist projectile having an elongated housing, a payload supported within and separable from the housing during flight, the payload having associated therewith a twist brake comprising a support member, a plurality of wings, and means for pivoting one end of each wing to the support member, the wings being normally confined within the housing and pivotable outwardly from the support member upon separation of the payload from the housing to brake the rotational speed of the separated payload, the improvement wherein the twist brake further comprises a guide shoe interposed between each of the confined wings and the confronting wall of the housing to prevent contact of the wings with the housing, the inner surface of the guide shoe having a first portion for removably contacting the associated confined wing.

2. A projectile as defined in claim 1, further comprising means cooperatively arranged on the support member and the guide shoe for preventing substantial movement of the guide shoe in at least one direction while the guide shoe is in engagement with the associated wing.

3. A projectile as defined in claim 2, in which the support member comprises a centrally disposed shaft in the payload, and in which the movement preventing means comprises, in combination, a projection extending radially from the outer surface of the shaft, and means defining a slot extending inwardly from the inner surface of a second portion of the guide shoe for receiving the projection on the shaft to inhibit axial movement of the shoe with respect to the shaft.

4. A projectile as defined in claim 3, in which the support member comprises a shaft centrally disposed in the payload, and in which the movement preventing means comprises, in combination, a projection extending radially from the outer surface of the shaft, a slot extending radially inward from the outer surface of the projection, and a pin extending axially from an end of the guide shoe and received within the slot in the projection of the shaft to inhibit circumferential movement of the guide shoe. with respect to the shaft.

* * * * *